United States Patent [19]

Grieb et al.

[11] Patent Number: 4,766,953

[45] Date of Patent: Aug. 30, 1988

[54] SHAPED TUBE WITH ELLIPTICAL CROSS-SECTION FOR TUBULAR HEAT EXCHANGERS AND A METHOD FOR THEIR MANUFACTURE

[75] Inventors: Hubert Grieb, Germering; Werner Schlosser, Munich, both of Fed. Rep. of Germany

[73] Assignee: MTU Motoren-und Turbinen-Union München GmbH, Munich, Fed. Rep. of Germany

[21] Appl. No.: 29,671

[22] Filed: Mar. 24, 1987

[30] Foreign Application Priority Data

Mar. 29, 1986 [DE] Fed. Rep. of Germany ..... 3610618

[51] Int. Cl.[4] ..... F28F 1/02

[52] U.S. Cl. ..... 165/177; 138/117; 228/173.7; 29/157.4

[58] Field of Search ..... 165/177, 179; 29/157.4; 138/115, 117, 157; 228/152, 173.7, 183

[56] References Cited

U.S. PATENT DOCUMENTS

| | | | |
|---|---|---|---|
| 1,431,368 | 10/1922 | Bundy | 138/171 |
| 1,477,209 | 12/1923 | Cowan | 165/177 |
| 1,929,365 | 10/1933 | Mautsch | 165/177 X |
| 2,009,863 | 7/1935 | Trane | 165/177 |
| 2,979,806 | 4/1961 | Macomber | 29/155 R |
| 2,998,047 | 8/1961 | Mally et al. | 72/368 |
| 3,416,600 | 12/1968 | Fink | 165/177 X |
| 3,486,489 | 12/1969 | Huggins | 165/177 |
| 3,976,126 | 8/1976 | Ruff | 165/900 X |
| 4,306,619 | 12/1981 | Trojani | 165/179 |
| 4,443,921 | 4/1984 | Allemandou | 165/177 X |
| 4,470,452 | 9/1984 | Rhodes | 165/179 X |

FOREIGN PATENT DOCUMENTS

| | | | |
|---|---|---|---|
| 280017 | 3/1970 | Austria . | |
| 43780 | 8/1887 | Fed. Rep. of Germany . | |
| 2031904 | 1/1972 | Fed. Rep. of Germany . | |
| 3327660 | 12/1984 | Fed. Rep. of Germany . | |
| 491267 | 5/1919 | France . | |
| 2261819 | 9/1975 | France . | |
| 538018 | 7/1941 | United Kingdom | 165/179 |
| 2046139 | 11/1980 | United Kingdom | 165/179 |
| 24338 | 7/1986 | United Kingdom . | |

*Primary Examiner*—Ira S. Lazarus
*Assistant Examiner*—Richard R. Cole
*Attorney, Agent, or Firm*—Barnes & Thornburg

[57] ABSTRACT

A shaped tube with an elliptical cross-section with a multichamber design for tubular heat exchangers is provided with at least two cross ribs passing through an interior space of the tube at a distance from one another. A method for making this tube provides for bending an endless metal strip into two semifinished products with congruent profiles. Each profile has the shape of an isosceles triangle with rounded vertices and an elongated leg. The semifinished products are then placed against one another so that the free end of the elongated leg of one semifinished product abut the triangle base edge of the other semifinished product.

15 Claims, 2 Drawing Sheets

SHAPED TUBE WITH ELLIPTICAL CROSS-SECTION FOR TUBULAR HEAT EXCHANGERS AND A METHOD FOR THEIR MANUFACTURE

BACKGROUND AND SUMMARY OF THE INVENTION

The present invention relates to a shaped tube with an elliptical or lancet-shaped cross section for tubular heat exchangers, manufactured from thin-walled sheet metal.

A tube of this general type is shown in German Unexamined Patent Application No. 33 27 660, this tube being divided into two chambers by a cross rib running centrally in the direction of the minor ellipse axis (two-chamber profile). In the shaped tubes manufactured from thin-walled sheet metal, such a cross rib serves both to stiffen the tube to prevent the slightly convex tube walls from flattening out and to increase the degree of heat exchange. It has been found that the efficiency of such a tubular heat exchanger can be increased by using in the matrix, shaped tubes with especially slender lancet cross sections.

An objective of the present invention therefore is to provide a shaped tube with an elliptical or lancet-shaped cross-section which has a slender contour and is able to withstand high internal pressure, permits a high degree of heat exchange, and can therefore bring about the smallest possible flow losses inside.

This and other objectives are achieved by the present invention by providing a shaped tube with an elliptical or lancet-shaped cross-section with at least two cross ribs passing through the interior at a distance from one another parallel to the minor ellipse axis.

Subdivision of the shaped tube according to the invention into at least three chambers offers a considerable improvement of flow and heat exchange conditions over a two-chamber profile. Particularly in the case of shaped tubes with larger cross sections for heat exchangers with larger dimensions, by using the multichamber design, equally thin sheet metal can be used as for small shaped tubes in the two-chamber design without thereby unacceptably reducing resistance to flattening out.

The present invention also relates to a method for manufacturing shaped tubes with elliptical or lancet-shaped cross sections for tubular heat exchangers with at least two cross ribs passing through the interior space at a distance from one another in the direction of the minor ellipse axis by bending endless metal strips and then fitting the free edges together. A method of this general kind has been disclosed for a two-chamber profile by the above-mentioned German Published Unexamined Patent Application No. 33 27 660.

An object of the present invention is to provide a method suitable for making multichamber shapes which, while taking into account the very thin walls to be processed, both guarantees high dimensional accuracy of the shaped tubes produced and also is adjustable in terms of the number of desired chambers, while also allowing high production levels.

This and other objects are achieved according to the present invention by bending an endless metal strip into two semifinished products with congruent profiles. Each said profile has the shape of an isosceles triangle with rounded vertices and with one leg extended beyond the base. The semifinished products are then placed against one another so that each free end of an elongated leg abuts the base edge of the other semifinished product.

The method according to the invention provides a tube that has a slender contour, is able to withstand a high internal pressure, and permits a high degree of heat exchange. It also ensures a low engineering cost since the construction from two congruent semifinished products means that only one relatively simple profile need be bent.

A further preferred embodiment of this method according to the present invention provides the manufacture of shaped tubes with more than two (2+n) cross ribs. In this method, n intermediate parts with rectangular Z contours and free legs are interposed between the two semifinished products. In this way, multichamber lancet profiles with a maximum of two differently-bent shaped semifinished products can be assembled, with the manufacturing cost being kept low.

According to one preferred embodiment of the method according to the present invention, the semifinished product is bent, with the initially flat metal strip first being shaped into a right-angled Z shape with two free legs. Then the longer of the free legs is bent at approximately half the length of the longer leg by more than 90° so that its end edge abuts the base edge formed by the Z rib and the shorter free leg. This type of bending of the semifinished product is especially advantageous in view of the subsequent fitting together, since the edges to be fitted together are in the areas of flat or slightly convex surfaces and are therefore especially easily accessible.

Alternatively to the above-described bending of the semifinished products, according to another preferred embodiment of the invention, a semifinished product is shaped by first bending the initially flat metal strip into a right-angled profile with a shorter leg that has the same length as the cross rib and a longer leg. The longer leg is then bent for more than 90° around a point which is less than half the length of the leg from the right-angled vertex, until it abuts the free end of the shorter leg. This type of bending of the semifinished product has the advantage that the flat metal strip is subjected to bending in one direction only.

Preferably, the distance of the bending point from the right-angled vertex is about one-third of the length of the longer leg, so that the lengths of the three chambers of the finished shaped tube are about the same.

Especially with respect to a fitting together of the free edges by welding, it is advantageous for the free legs of the semifinished products and the intermediate parts to have end edges bent outward, as provided by certain preferred embodiments of the method according to the present invention.

Although the method according to the present invention can be worked so that the triangular hollow shapes of the two semifinished products can initially be sealed, and then the semifinished products can be joined to one another or with interposition of intermediate parts, it is advantageous for sealing each semifinished product as well as the fitting together of the semifinished products with one another or with the intermediate parts to take place in the same work process. This considerably facilitates the manufacture of endless shaped tubes.

Other objects, advantages and novel features of the present invention will become apparent from the following detailed description of the invention when considered in conjunction with the accompanying drawings.

DETAILED DESCRIPTION OF THE DRAWINGS

Figure 1:
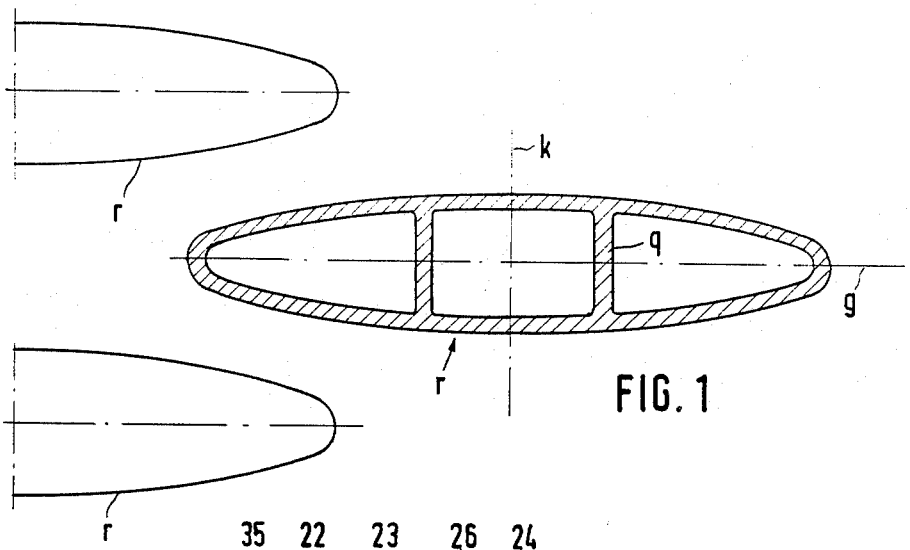
FIG. 1 is a cross-section of a shaped tube in a matrix connection constructed in accordance with a preferred embodiment of the present invention.

In FIG. 1, three shaped tubes r of a tubular heat exchanger matrix are shown in their staggered arrangement, one of them in cross section and the other two only in outline. The elliptical shaped tubes shown in cross-section have two cross ribs q traversing the inner space at a distance from one another parallel to the minor ellipse axis k. This produces two roughly triangular hollow chambers at both ends of an approximately rectangular hollow chamber. It is evident from FIG. 1 that the so-called three-chamber profile shown already has a shape of a very slender ellipse, whose wall parts are correspondingly slightly convex. Accordingly, in contemplated embodiments having multichamber profiles which have 2+n cross ribs, even more slender tube contours are produced.

Figure 2:
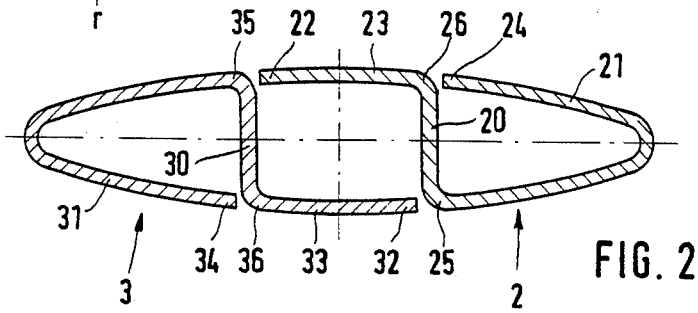
FIG. 2 shows semifinished products joined together for a shaped tube according to FIG. 1 in a first embodiment.

The diagram in FIG. 2 shows a first type of manufacture according to the invention for a shaped tube according to FIG. 1. According to the drawing, by bending endless metal strip, the two semifinished products 2, 3 which have a congruent profile are formed. Each of these semifinished products 2, 3 has roughly the shape of an isosceles triangle with rounded vertices and with one leg 23 or 33 extended beyond the bases 20, 30. These semifinished products 2, 3 are placed against one another so that free ends 22, 32 of elongated legs 23, 33 each abut the base edge 25, 35 of the other semifinished product. The junctions at edges 25, 26, 35, 36 shown in FIG. 2 still as open gaps are sealed by welding or soldering.

Figure 4:
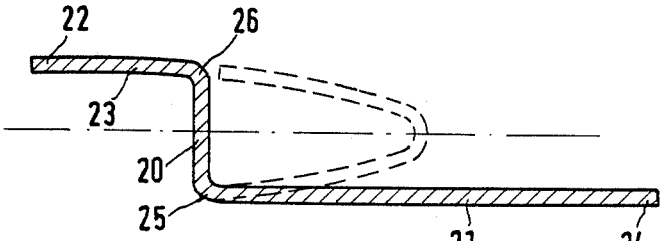
FIG. 4 shows the bending of a thin-walled sheet to form the semifinished product according to FIG. 2.

The bending of the semifinished products 2, 3 shown in FIG. 2, as indicated in FIG. 4, is performed such that the originally flat metal strip is first shaped into a right-angled Z contour with free legs, 21, 23. The longer of the free legs 21 is then bent further at approximately half the length of the leg 21 so that its end edge 24 abuts base edge 26. Solid lines show the right-angled Z contour while the bending of the longer leg 21 is indicated by the dashed line.

Figure 3:
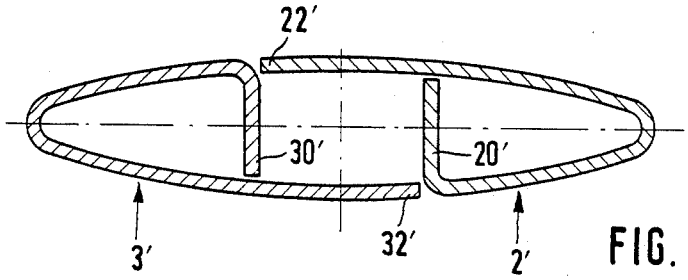
FIG. 3 shows semifinished products joined together for the shaped tube according to FIG. 1 in a second embodiment.
Figure 5:
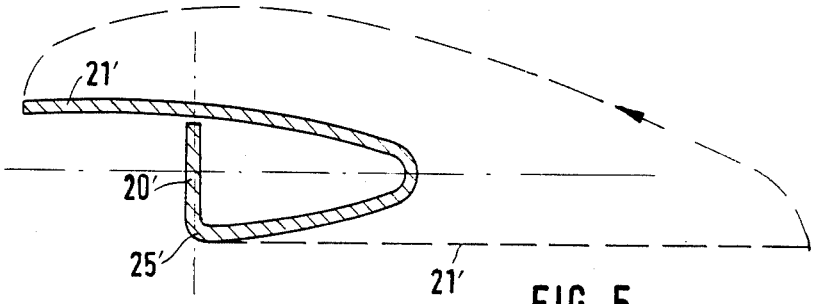
FIG. 5 shows the bending of a thin-walled sheet to form the semifinished product according to FIG. 3.

FIGS. 3 and 5 show a second method of manufacturing an elliptical shaped tube according to the embodiment of FIG. 1. Similar parts have been given similar reference numerals in FIGS. 2–5. As in the case of the first method of manufacture shown in FIG. 2, once again two semifinished products 2, 3 with congruent profiles are bent and placed against one another so that the complete profile of the tube according to FIG. 1 results. In contrast to the method of manufacture shown in FIGS. 2 and 4 however, a semifinished product 2', 3' is so shaped that the originally flat metal strip is first bent into a right angle profile with one shorter leg 20' which has the length of cross rib q of the shaped tube and a longer leg 21'. Longer leg 21' is then bent around a point which lies less than half the length of the leg from right-angled vertex 25' until leg 21' abuts the free end of shorter leg 20'. The movement of the end edge of longer leg 21' is represented in FIG. 5 by a dashed line and arrow. Preferably, the point at which longer leg 21' is bent is approximately one-third of the total length of the leg. Thus, in the finished profile tube, the middle rectangular chamber is approximately the same length as the two outer triangular chambers.

Figure 6:
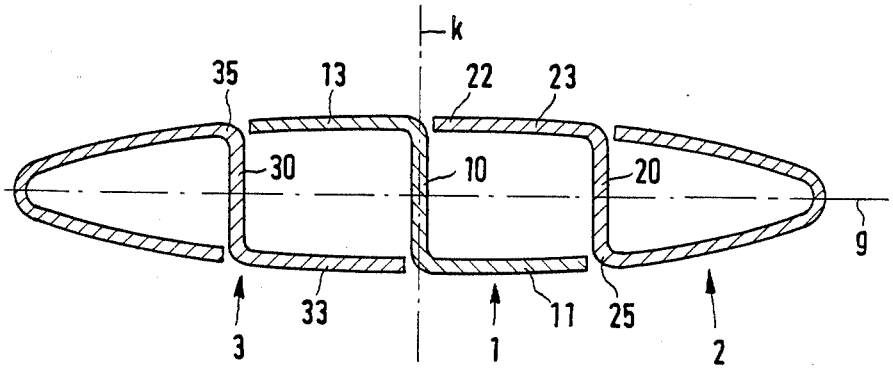
FIG. 6 shows the joining of completely bent semifinished products to form a shaped tube with three cross ribs.
Figure 7:
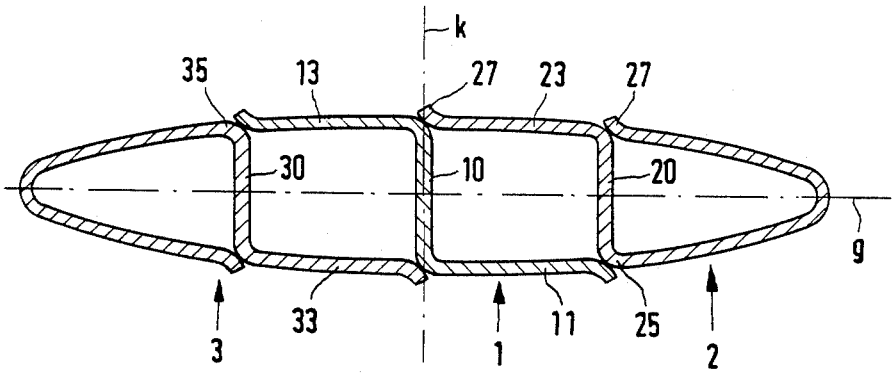
FIG. 7 is another embodiment of an arrangement similar to FIG. 6.

FIG. 6 shows the manufacture of an elliptical shaped tube with four chambers. The overall contour of this shaped tube is formed by two congruent semifinished products 2, 3 described above and an intermediate part I, which has a right-angled Z contour with free legs 11, 13. The Z rib of intermediate part 1 is represented by reference numeral 10. The other reference numbers are the same as in FIG. 2. The finished shaped tube results as described above from the welding or soldering of the joining gaps. Shaped tubes of even greater length in the direction of major ellipse axis g are produced by inserting a plurality of intermediate parts 1 in similar fashion between the two semifinished products 2 and 3. The embodiment shown in FIG. 7 of the semifinished products joined to form the contours of the tube differs from the embodiment shown in FIG. 6 only in that the free legs of semifinished products 2, 3 and intermediate part 1 to be joined together have outwardly bent end edges 27. This type of contour has proven to be especially advantageous for performing the welding.

It should be noted that the figures contain considerably enlarged representation of the shaped tubes to be manufactured. In certain preferred embodiments, the extent of the elliptical cross-sectional shape is about 10 mm in the direction of the major ellipse axis and about 3 mm in the direction of the minor ellipse axis, and the wall thickness of the sheet metal used is between 0.2 and 0.4 mm.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A shaped tube with an elliptical or lancet-shaped cross-section for tubular heat exchangers, formed from thin-walled sheet metal, comprising: at least two cross ribs passing through an interior space of said tube at a distance from one another and parallel to a minor ellipse axis of said tube, wherein said tube is formed by two metal strips bent into congruent profile semi-finished products, each said profile having approximately a shape of an isosceles triangle with rounded vertices and an elongated leg that is extended beyond a base of said triangle, said congruent profile semi-finished products being placed against one another and joined to one another so that a free end of said one elongated leg of one semi-finished product abuts a triangle base edge of the other semi-finished product.

2. A shaped tube according to claim 1, further comprising intermediate parts having a right-angle Z shape and free legs fitted between said two semi-finished products for providing said tube with additional cross ribs.

3. A shaped tube according to claim 2, wherein end edges of the free legs of the semi-finished products and the intermediate part to be fitted together are bent outwardly.

4. A shaped tube according to claim 1, wherein said semi-finished products are shaped from an initially flat metal strip into a right-angled Z shape with two free legs; the longer of the free legs being bent at approximately half the length of said longer free leg for more than 90° to a point where an end edge of said longer free leg abuts a base edge formed by a Z rib and the other free leg.

5. A shaped tube according to claim 1, wherein said semi-finished products are shaped from an initially flat metal strip into a right-angled profile with a shorter leg which has the length of one cross-rib and a longer leg; said longer leg being bent around a point which is less than half the length of said longer leg distant from a right-angled vertex of said right-angled profile until it touches a free end of said shorter leg.

6. A shaped tube according to claim 5, wherein said longer leg is bent around a point at a distance of approximately one-third of the length of said longer leg from said right-angled vertex.

7. A shaped tube according to claim 1, wherein at least three cross ribs pass through said interior space.

8. A method for manufacturing shaped tubes with elliptical or lancet-shaped cross-sections for tubular heat exchangers with at least two crossed ribs traversing the inner space at a distance from one another and parallel to a minor ellipse axis by bending endless metal strip and then joining the free edges, the method comprising:

bending said strip into two semifinished products with congruent profiles, each said profile having approximately a shape of an isosceles triangle with rounded vertices and an elongated leg that is extended beyond a base of said triangle, placing said semifinished products against one another so that a free end of said elongated leg of one semifinished product abuts a triangle base edge of the other semifinished product, and joining said semifinished products together.

9. A method according to claim 8, further comprising fitting intermediate parts having a right-angled Z shape and free legs fitted between said two semifinished products for providing said tube with additional cross ribs.

10. A method according claim 9, further comprising: bending outward of end edges the free legs of the semifinished products and the intermediate part to be fitted together.

11. A method according to claim 9, wherein a joining of each semifinished product as well as the joining of said semifinished products to said intermediate part is performed in the same work process as a sealing of each said semifinished product.

12. A method according to claim 8, wherein said bending of said strip into said semifinished products includes: shaping of said initially flat metal strip into a right-angled Z shape with two free legs; bending the longer of the free legs at approximately half the length of said longer free leg for more than 90° to a point where an end edge of said longer free leg abuts a base edge formed by a Z rib and the other free leg.

13. A method according to claim 8, wherein said bending of said strip into said semifinished products includes: bending said initially flat metal strip into a right-angled profile with a shorter leg which has the length of one cross rib and a longer leg; and bending said longer leg around a point which is less than half the length of said longer leg distant from a right-angled vertex of said right-angled profile until it touches a free end of said shorter leg.

14. A method according to claim 13, wherein said longer leg is bent around a point at a distance of approximately one-third of the length of said longer leg from said right-angled vertex.

15. A method according to claim 8, wherein a joining of said semifinished products to one another is performed in the same work process as a sealing of each said semifinished product.

* * * * *